US009283470B2

(12) United States Patent
Lando

(10) Patent No.: US 9,283,470 B2
(45) Date of Patent: Mar. 15, 2016

(54) TWO PARTY PUZZLE GAME

(76) Inventor: Mordechai Lando, Beer-Sheva (IL)

( * ) Notice: Subject to any disclaimer, the term of this patent is extended or adjusted under 35 U.S.C. 154(b) by 257 days.

(21) Appl. No.: 13/211,349

(22) Filed: Aug. 17, 2011

(65) Prior Publication Data

US 2012/0046085 A1 Feb. 23, 2012

Related U.S. Application Data

(60) Provisional application No. 61/375,874, filed on Aug. 23, 2010, provisional application No. 61/469,815, filed on Mar. 31, 2011.

(51) Int. Cl.

| | |
|---|---|
| ***A63F 9/24*** | (2006.01) |
| ***A63F 3/04*** | (2006.01) |
| *A63F 9/04* | (2006.01) |

(52) U.S. Cl.

CPC ..... *A63F 3/0457* (2013.01); *A63F 2003/046* (2013.01); *A63F 2003/0465* (2013.01); *A63F 2009/0426* (2013.01)

(58) Field of Classification Search

CPC ..... A63F 3/0457; A63F 2009/0426; A63F 2003/0465; A63F 2003/046

USPC ..... 463/9; 273/143 R, 157 R

See application file for complete search history.

(56) References Cited

U.S. PATENT DOCUMENTS

| | | | | |
|---|---|---|---|---|
| 481,589 | A * | 8/1892 | Proctor | 273/153 J |
| 3,858,333 | A * | 1/1975 | Kopp | 273/272 |
| 2008/0174069 | A1* | 7/2008 | Ouellet | 273/272 |
| 2011/0018196 | A1* | 1/2011 | Cabrera | 273/153 R |

* cited by examiner

*Primary Examiner* — Jasson Yoo

(57) ABSTRACT

It is provided a game system which includes 36 indexed elements, and a pattern structure having six hexagonal patterns arranged in a cycle such that each pattern has two neighboring patterns. Each element has an index of six different indexes. Two or more indexed elements are associated with each index. Each pattern has two sites shared with each of the two neighboring patterns, and one non-shared site. The system includes a cube for selecting a sub-set of 24 indexed elements. In a number version, the different indexes constitute a single arithmetic series. In a two-party game version, 12 pattern sites are associated with a first site index and 12 pattern sites are associated with a second index, six of the sites having the first site index and six of the sites having the second site index are shared sites, and the other sites are non-shared sites. A computerized two party game includes means for prohibiting a player from disposing an indexed element on a pattern site already having that indexed element.

6 Claims, 9 Drawing Sheets

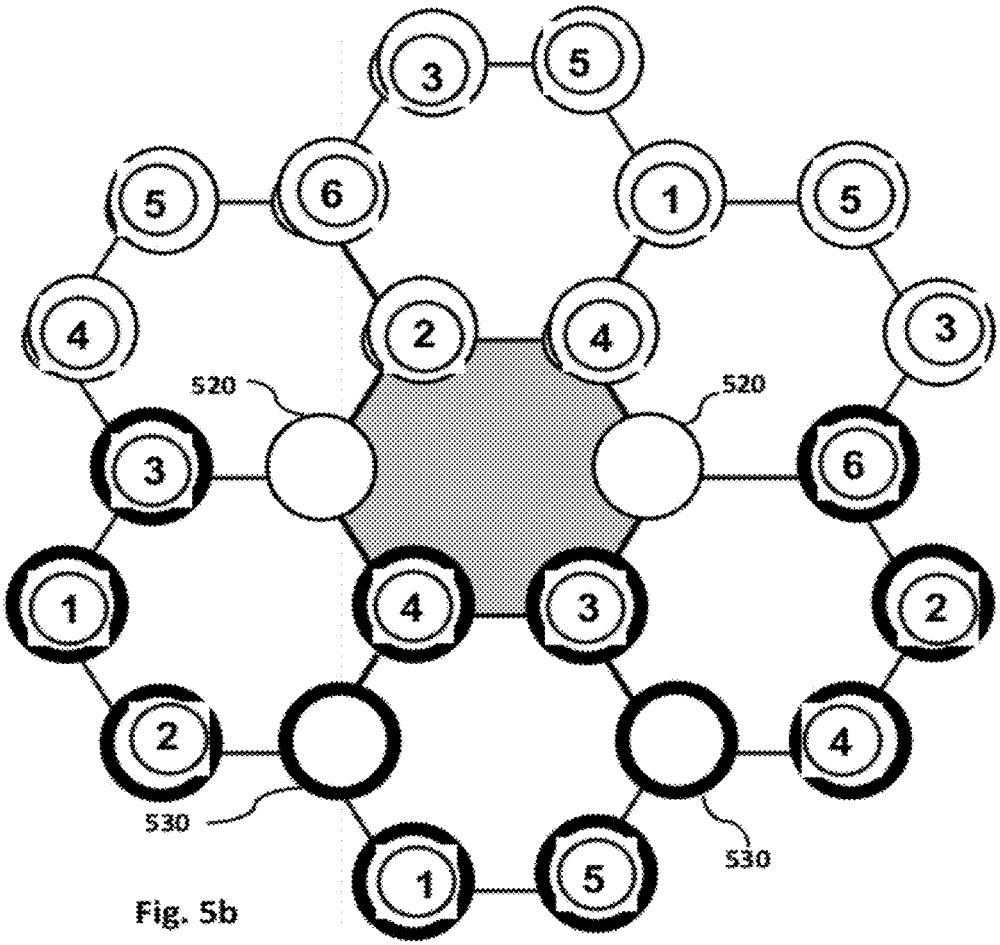
Fig. 5b
Fig.5c
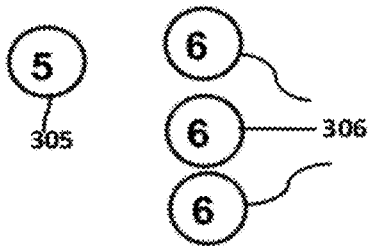

TWO PARTY PUZZLE GAME

CROSS REFERENCE

The application claims the priority rights of U.S. provisional application No. 61/375,874 entitled "METHOD AND SYSTEM FOR A MATHEMATICAL HONEYCOMB PUZZLE" filed Aug. 23, 2010 by the present inventor, and the priority rights of U.S. provisional application No. 61/469,815 entitled "METHOD AND SYSTEM FOR A TWO PARTY PUZZLE GAME" filed Mar. 31, 2011, by the present inventor.

BACKGROUND OF THE INVENTION

1. Field of the Invention

The invention is in the field of mathematical puzzles, which are either box games or computerized games, especially for mobile devices like touch smart phones.

2. Description of Related Art

The present invention relates to IL179388 filed 19 Nov. 2006 (also U.S. application Ser. No. 12/514,829 filed 14 May 2009 "Mathematical puzzle game") and to IL190579 filed 2 Apr. 2008 (also U.S. application Ser. No. 12/936,207 entitled "A Latin Game", filed Feb. 10, 2010) both to the present inventor. These two US applications are incorporated here by reference for all purposes.

BRIEF SUMMARY OF THE INVENTION

It is provided according to embodiments of the current invention, a game system which includes a plurality of indexed elements, and a structure having a second number of patterns arranged in a cycle such that each pattern has two neighboring patterns. Each element is associated with an index selected from a group of a first number of different indexes. The first and second numbers are each larger than four, preferably they are the number six. At least two indexed elements are associated with each index, preferably between three and six indexed elements.

Each pattern has a third number of sites shared with each of the two neighboring patterns, and the each pattern having a fourth number of non-shared sites. Each pattern is adapted to receive an indexed element. The third number is at least two, and the fourth number at least one. Preferably both the third number and the fourth number are each the number two.

In some embodiments, the system includes means for selecting a sub-set of indexed elements from the plurality of indexed elements by casting lots, preferably by using a cube having a data item appearing on each face of the cube.

In a game box version, the pattern structure is printed on a cardboard, and the indexed elements are made of wooden, plastic or metal material. Preferably, the first number of different indexes consists of different colors.

In some embodiments, the first number of different indexes consists of different numbers, preferably of a single arithmetic series.

In a computerized version, the pattern structure and the indexed elements are displayed on a screen and the elements may be dragged between screen destinations. Preferably, the screen is a touch screen.

In some embodiments, the system includes exactly 36 indexed elements, and six indexed elements are associated with each of the different indexes. 24 indexed elements are selected by casting lots for a game round, and each different index is associated with three to six selected indexed elements. Preferably, the structure has six hexagonal patterns.

In a two-party game version, each pattern site is associated with either a first site index or a second site index. 12 pattern sites are associated with the first site index and 12 pattern sites are associated with the second index. Preferably, exactly six of the sites having the first site index and exactly six of the sites having the second site index are shared sites, and the other sites are non-shared sites.

A computerized two party game version includes means for supporting such a game, like a score table, means for prohibiting a player from disposing indexed elements on pattern sites associated with a certain site index, means for prohibiting a player from disposing a certain indexed element on a certain site of a certain pattern in case that the pattern already has that index. Another desired means is for announcing a game loss as a result of unavailability of a disposal motion, in accordance with the above prohibition.

It is provided a method for a computerized two party game, which includes providing a game system as mentioned above, allowing a legal disposal of an indexed element on certain pattern site of certain pattern by an active player, and providing a lose declaration in case of no available legal disposal. The disposal is legal if the active player is associated with a site index of the certain pattern site, and no identical indexed element resides on another pattern site of the certain pattern.

BRIEF DESCRIPTION OF THE DRAWINGS

The subject matter regarded as the invention is particularly pointed out and distinctly claimed in the concluding portion of the specification. The invention, however, both as to system organization and method of operation, together with features and advantages thereof, may best be understood by reference to the following detailed description when read with the accompanied drawings in which:

FIG. 5*b* shows an arrangement of 20 numbered elements on the honeycomb structure during a two party game.

FIG. 5*c* shows four numbered elements available for disposal on the honeycomb structure.

DETAILED DESCRIPTION OF THE INVENTION

Figure 1A:
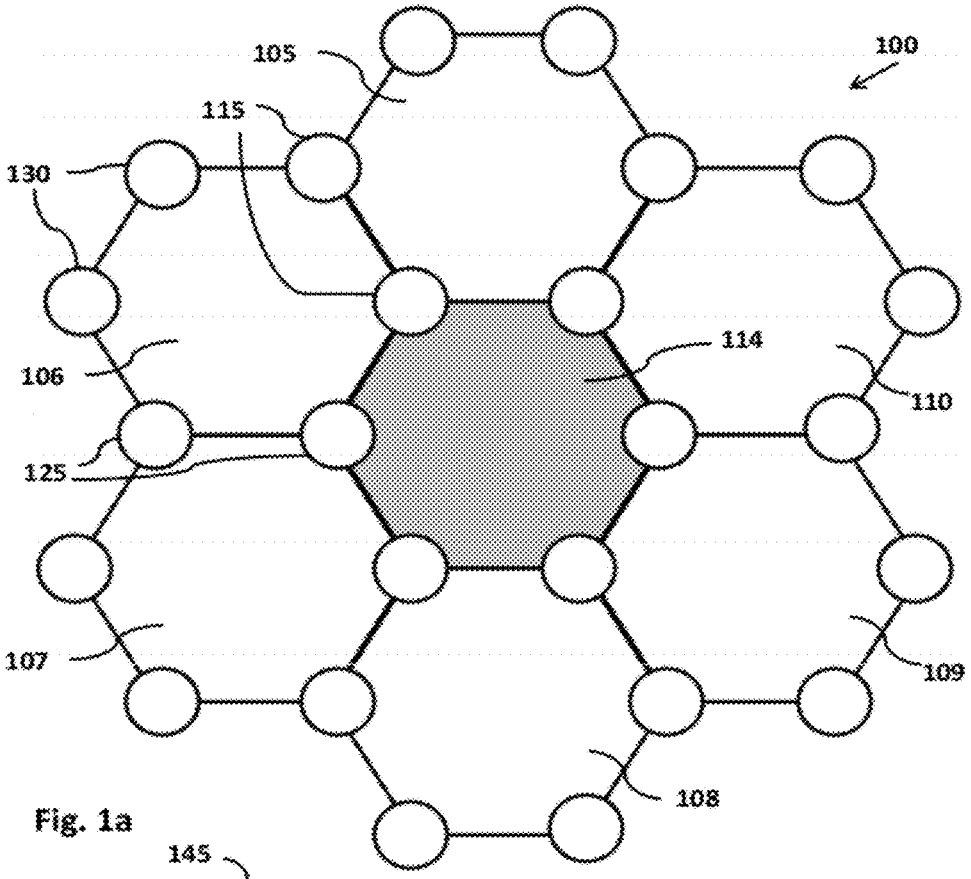
FIG. 1*a* illustrates a honeycomb structure including six hexagons in a cycle.

The present invention will now be described in terms of specific example embodiments. It is to be understood that the invention is not limited to the example embodiments disclosed. It should also be understood that not every feature of the methods and systems handling the described game is necessary to implement the invention as claimed in any particular one of the appended claims. Various elements and features of devices are described to fully enable the invention. It should also be understood that throughout this disclosure, where a method is shown or described, the steps of the method may be performed in any order or simultaneously, unless it is clear from the context that one step depends on another being performed first.

Before explaining several embodiments of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Unless otherwise defined, all technical and scientific terms used herein have the same meaning as commonly understood by one of ordinary skill in the art to which this invention belongs. The systems, methods, and examples provided herein are illustrative only and not intended to be limiting.

In the description and claims of the present application, each of the verbs "comprise", "include" and "have", and conjugates thereof, are used to indicate that the object or objects of the verb are not necessarily a complete listing of members, components, elements or parts of the subject or subjects of the verb.

A Color Game Embodiment

Figure 1B:
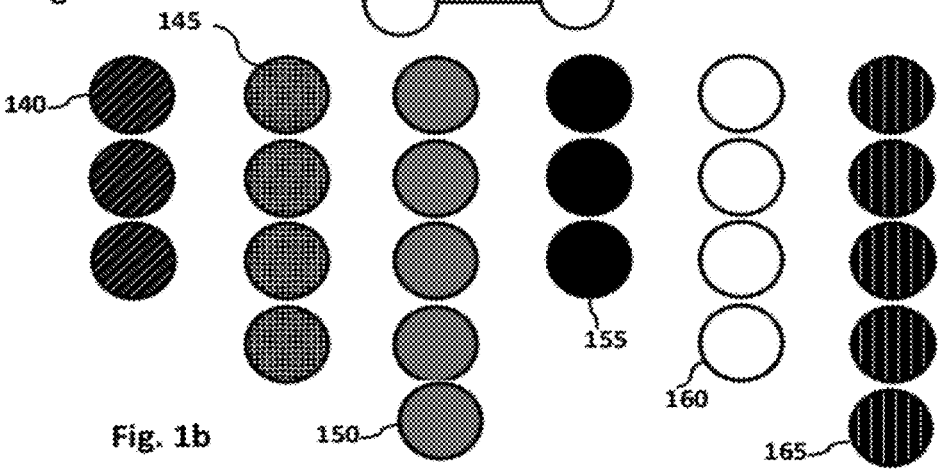
FIG. 1*b* illustrates 24 indexed elements of six different indexes.
Figure 1C:
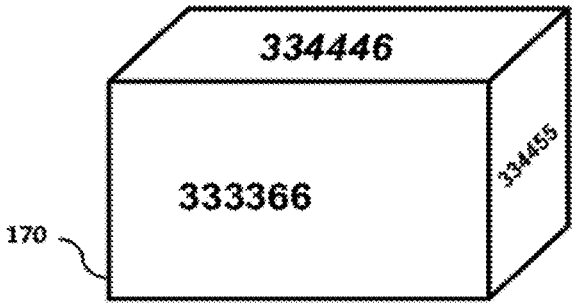
FIG. 1*c* presents a cube having a different repetition set on each face.

A color embodiment is described in FIGS. 1*a*, 1*b* and 1*c*. Planar structure or honeycomb structure 100 has six external hexagons 105, 106, 107, 108, 109, and 110 surrounding a central hexagon 114, with a node or a site 115, 125 or 130 at each hexagonal corner. External hexagon 106, for example, has two sites 115 shared with neighboring hexagon 105, two sites 125 shared with neighboring hexagon 107, and two non-shared sites 130 which are unique to hexagon 106. The game apparatus also includes at least 24 elements having one type of indices. In the example of FIG. 1*b*. The indexes are graphical designs of a circular shape; three elements 140 have white diagonal lines thereon, four elements 145 have cross lines, five elements 150 have grey color, three elements 155 have black color, four elements 160 have white color and five elements 165 have white vertical lines on a black background. The distribution of the indexes on the 24 elements is called a repetition set. For convenience, repetition sets are arranged in a non-decreasing order, hereafter increasing repetition set. Thus, in the example of FIG. 1*b*, the increasing repetition set is (334455).

Figure 2:
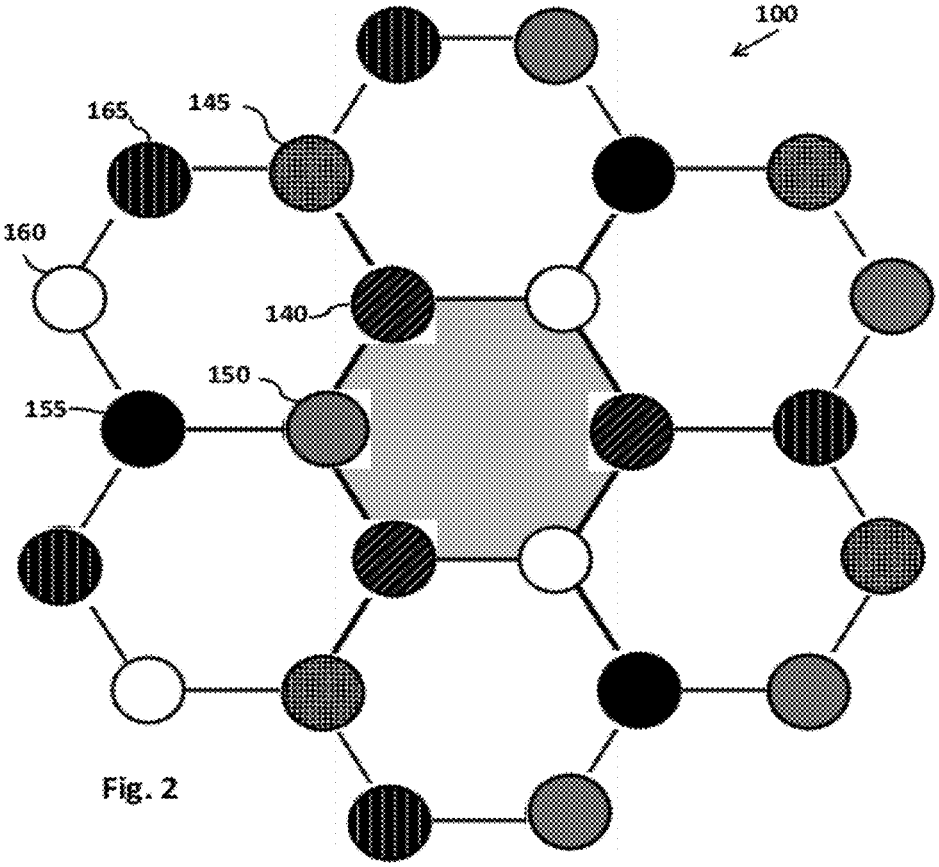
FIG. 2 shows a Latin arrangement of indexed elements on the sites of the hexagonal patterns of the honeycomb structure.

A player gets instructions to dispose the 24 elements on the 24 sites such that each external hexagon has elements of six different indexes, as shown in the exemplary arrangement of FIG. 2.

Such an arrangement of different indexes in each pattern, like the hexagonal pattern of the honeycomb diagram, is called in general a Latin arrangement, and is known in a diversity of fields includes games, puzzles and multi-variable statistical analysis. In the famous SUDOKU puzzle, for example, one has to simultaneously get Latin arrangements of the numbers 1-9 in nine row patterns, nine column pattern and nine 3×3 square patterns.

In the case of the honeycomb diagram 100, there are seven increasing repetition sets which enable a Latin arrangement, as follows: (333366), (333456), (333555), (334446), (334455), (344445), (444444).

Preferably, the game includes a cube, as shown in FIG. 1*c*, having a different increasing repetition sets on each of the six faces, wherein the (444444) repetition set, for example, does not appear on any cube face. The game also includes 36 elements, six at each index. The player throws the cube and reads a repetition set from the upper face, (334446) in the example of FIG. 1*c*. For that exemplary reading, the player picks three elements of a first index, three elements of a second index, four element of a third index, and so on, until the player has 24 elements for disposing on the 24 sites of honeycomb diagram 100. Preferably, the indexes are six different colors, six different images, six different shapes, six different numbers, 1-6 for example, or a combination thereof.

A computerized embodiment may be played online on a website, or as a mobile game on a smart touch phone, for example. A virtual cube may have initially arbitrary six sets of the seven increasing repetition sets for a first throwing of the cube. Afterwards, the recently played repetition set is eliminated from the group of seven sets such that the virtual cube includes the remaining six increasing repetition sets, and is thrown to select an increasing repetition set for the next game.

Once a repetition set has been determined, the order of the indexes may be also determined by a computerized lots casting, such that there are numerous sets of 24 elements for play. Since there are only seven different sets, ignoring identity of the indexes, the game is relatively easy and may be played by kids starting at an age of 7.

Rather than playing the color game as a stand alone game, it may serve as an introducer to a two party game, presented below.

A Number Game Embodiment

Figure 3A:
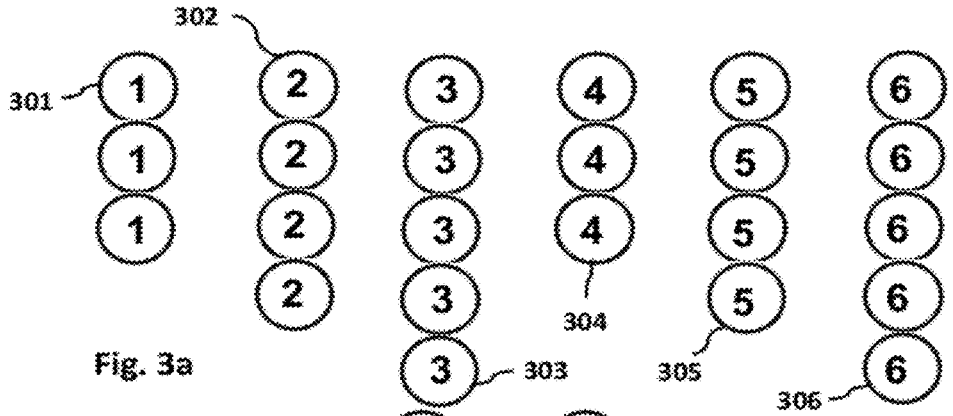
FIG. 3*a* presents 24 numbered elements of six consecutive numbers.
Figure 3B:
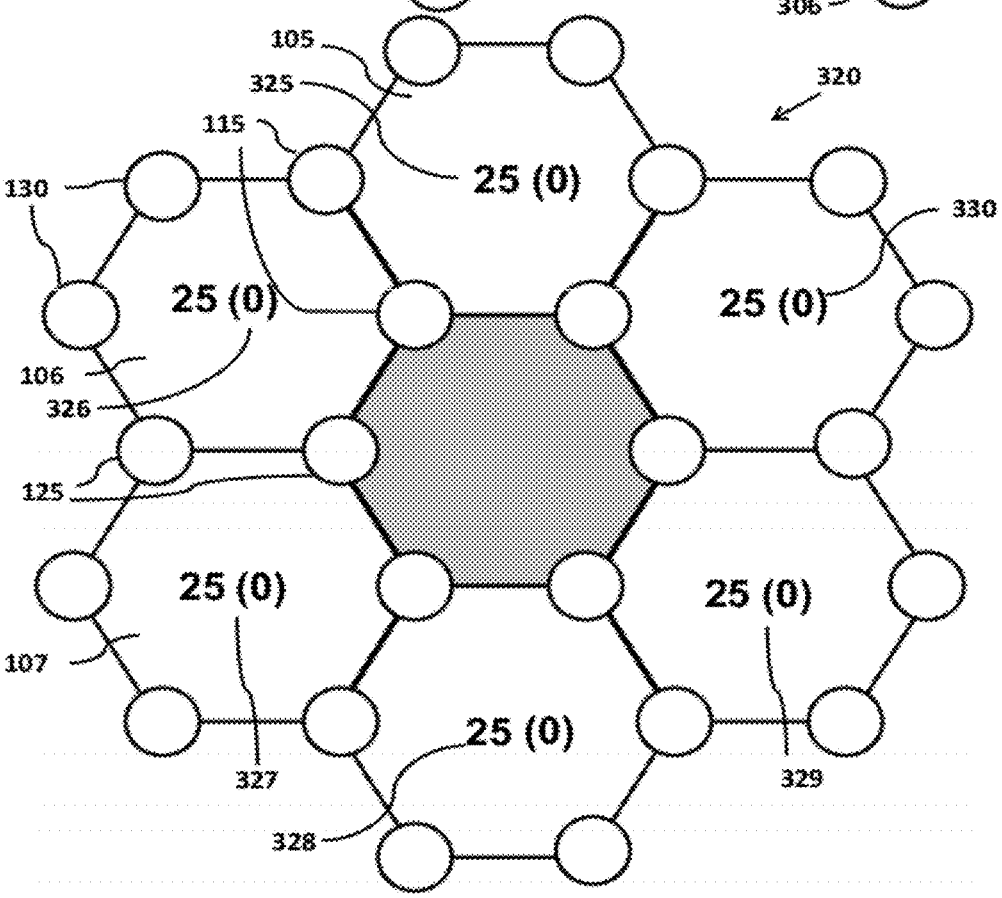
FIG. 3*b* illustrates a honeycomb structure with a designated desired sum in each hexagon.

A more challenging game, a number game, is presented in FIGS. 3*a* and 3*b*. Numbered elements 301, 302, 303, 304, 305 and 306 of FIG. 3*a* have consecutive numbers 1-6 as indexes. Honeycomb structure 320 has a site 325 in the center of hexagon 105 for disposing a desired sum number, 25 in the example of FIG. 3*b*, and an actual sum number in parenthesis, 0 in the example as no indexed element has been disposed. Game rule may call the player to place elements 301-306 on the sites 115, 125 and 130 of FIG. 3*b* such that the sum result of the six numbers of the six numbered elements disposed on sites of each external hexagon 105-110 equals the sum number as appears on the left hand side of hexagon center sites 325, 326, 327, 328, 329 and 330.

A numbered element disposed in site 115 contributes to both the actual sum in site 325 of hexagon 105 and to the actual sum in site 326 of hexagon 106. Similarly, a numbered element disposed in site 135 contributes to both the actual sum in site 327 of hexagon 107 and to the actual sum in site 326 of hexagon 106. In contrast, a numbered element disposed in site 130 contributes only to the actual sum in site 326. Thus, by moving the elements from one site to another, a player may accomplish the desired goal of having actual sums identical to the desired sums at sites 325-330.

In case all the sums are identical, a nice starting arrangement is a Latin arrangement, resulting in the equal sum of 21 for the numbers 1-6. Swapping numbered elements between two sites may help to propagate towards a satisfactory solution of the challenge.

Rather than being equal, the required sum results may be different. Also, at least part of the index numbers may be non-consecutive, non-integers or non-positive. In addition, some numbers may be placed on the honeycomb initially. Preferably, the initially placed numbers are fixed and should not be removed, such that the player is challenged to place the rest of the elements and get the desired sum results, without replacing the fixed numbers. Alternatively, the game instructions allow moving the initially placed number indexes to other sites.

A Two Party Game Embodiment

Figure 4A:
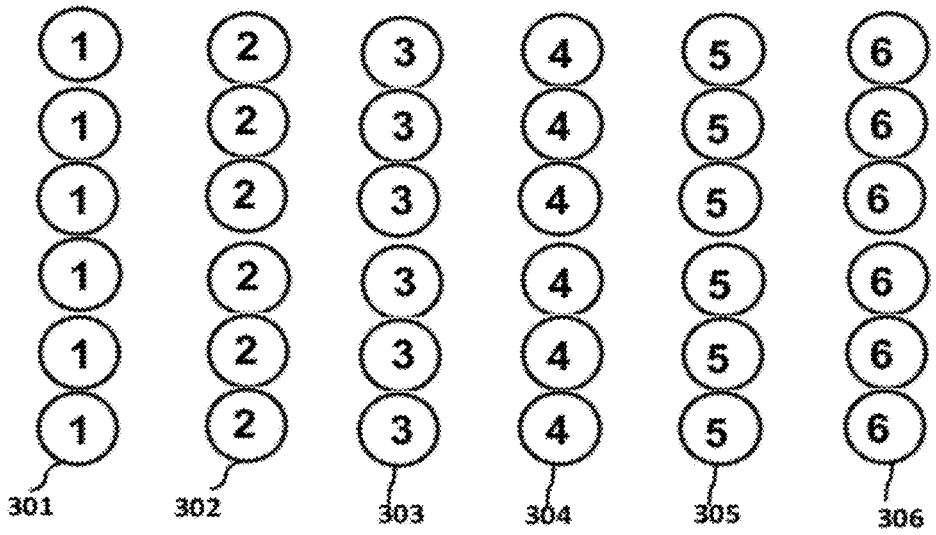
FIG. 4*a* presents 36 numbered elements of six consecutive numbers.
Figure 4B:
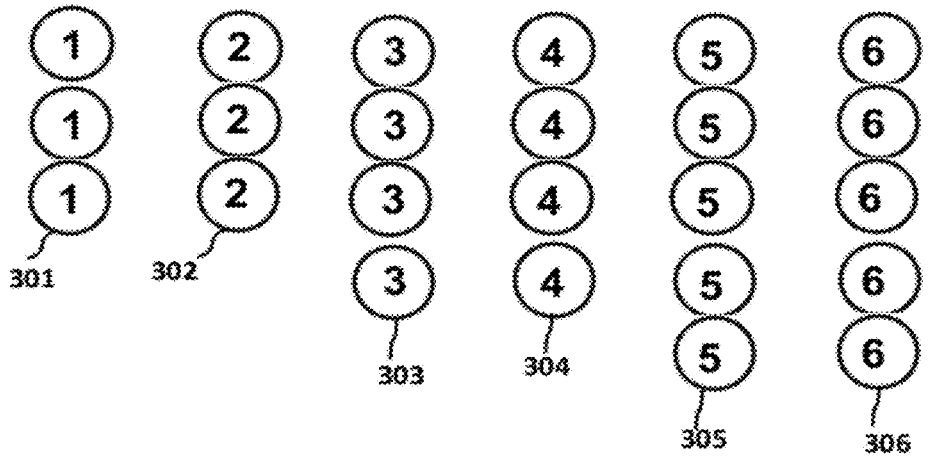
FIG. 4*b* presents 24 numbered elements selected from the set of 36 numbered elements in accordance with a 334455 repetition set.
Figure 5A:
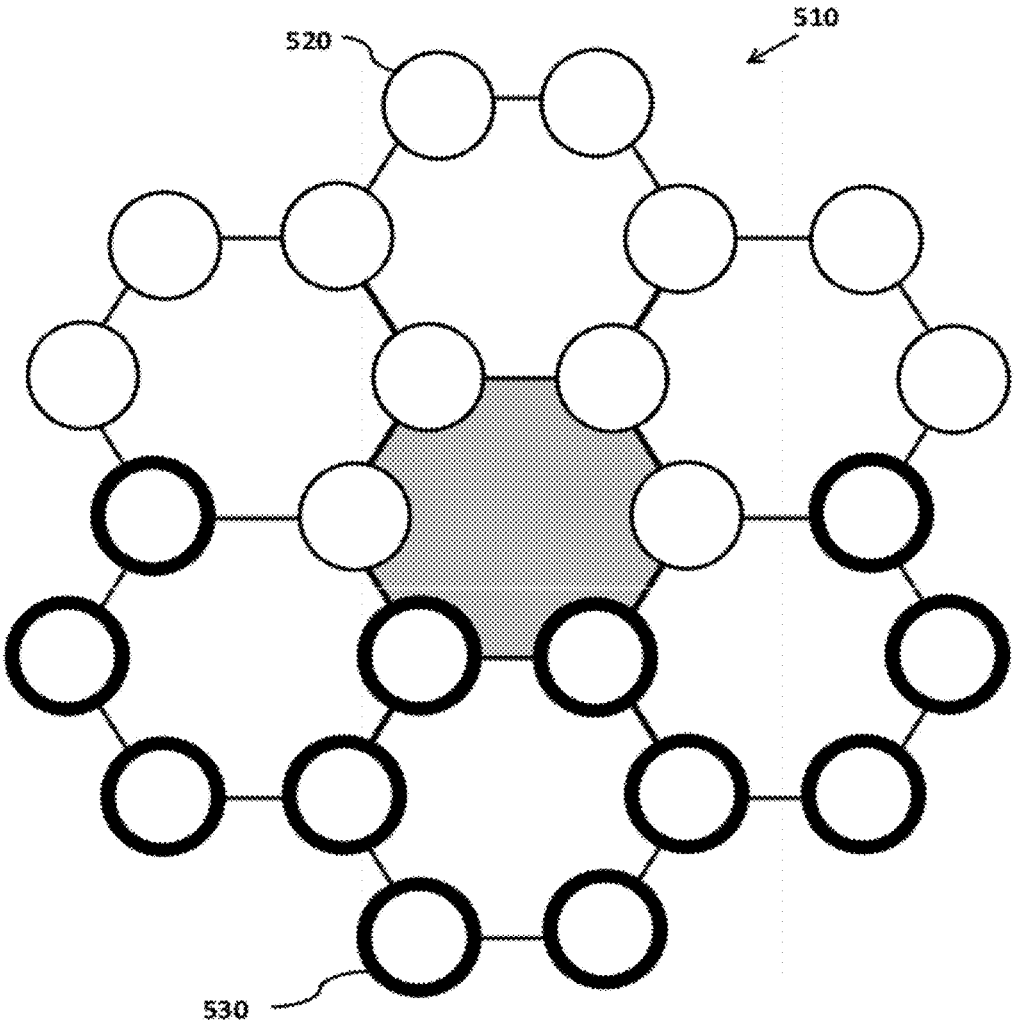
FIG. 5*a* illustrates a honeycomb structure having 12 indexed sites of a first site index and 12 indexed sites of a second site index.

The game apparatus includes several items as depicted in FIGS. 4*a*, 1*c* and 5*a*. FIG. 4*a* shows 36 indexed disk elements, wherein each indexed disk element 301-306 has an index selected from six different indexes 1-6. FIG. 1*c* illustrates a die cube 170 having on each face a repetition set. FIG. 4*b* shows 24 numbered elements of a repetition set (334455) elected by throwing dice 170.

FIG. 5*a* depicts six external hexagons surrounding a central hexagon, in a honeycomb configuration. Each external hexagon has six indexed sites 520 or 530. 12 hexagonal sites 520 are indexed by a thin circular line, while 12 hexagonal sites 530 are indexed by a thick circular line.

In an exemplary set of game rules, a first player has 12 thin line circle sites 520 and a second player has 12 thick line circle sites 530. The players agree that a certain player is the beginning active player in a first round of the game. Consequently, the other player takes the rule of an active player, and so on until one player losses, as described below. One of the players throws the dice to select a repetition set. According to the selected repetition set, a common bank is made of 24 indexed elements from the available 36 indexed elements. In the example of FIGS. 4*a* and 4*b*, the selected repetition set is (334455). Accordingly, the bank of FIG. 4*b* includes three 1-indexed elements 301, three 2-indexed elements 302, four 3-indexed elements 303, four 4-indexed elements 304, five 5-indexed elements 305, and five 6-indexed elements 306.

In the next move, the active player picks an indexed element from the bank and disposes it in one of the empty sites which he/she has. It is forbidden to dispose two identical indexed elements on the same external hexagon. Once an active player is unable to dispose any available indexed element in any available site he/she has in his/her turn, the active player loses the game. In the example of FIG. 5*b* and FIG. 5*c*, each of the players has two empty sites, and a single element 305 and three elements 306 are available in the bank. The player having thin line sites 520 is not able to dispose either element 305 or element 306 on any of the two empty sites 520. Consequently, if it is his/her turn to play, that player loses the game round. In contrast, the player having thick line sites 530 may dispose element 306 on the left empty site 530, such that if it is his/her turn he/she does not have to declare a loss.

An additional possible rule is that the beginning player switches every game round. Also, in case all 24 elements have been disposed in appropriate sites, a draw is declared.

Rather than numbers, the elemental indexes may be different elemental shapes or elements of different colors. Also, there may be less than 36 elements, 34 or 35 elements, for example. Also, there may be or more than 36 elements. Non-Latin repetition sets may be used as well.

In a box version, the elements selected for a certain round of the game may be taken from a page having a long list of repetition sets, thus saving the need for a cube.

Figure 6:
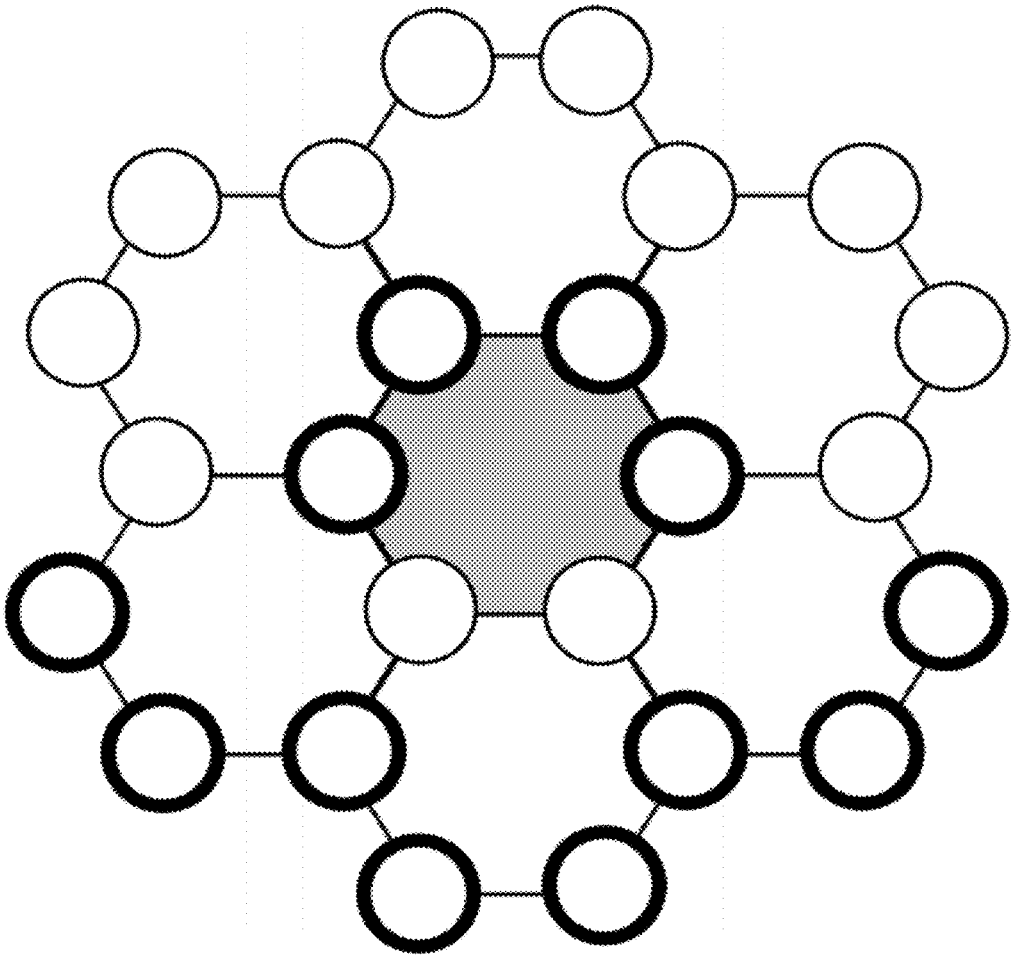
FIG. 6 illustrates a honeycomb structure where each hexagon has at least one site of each site index.
Figure 7:
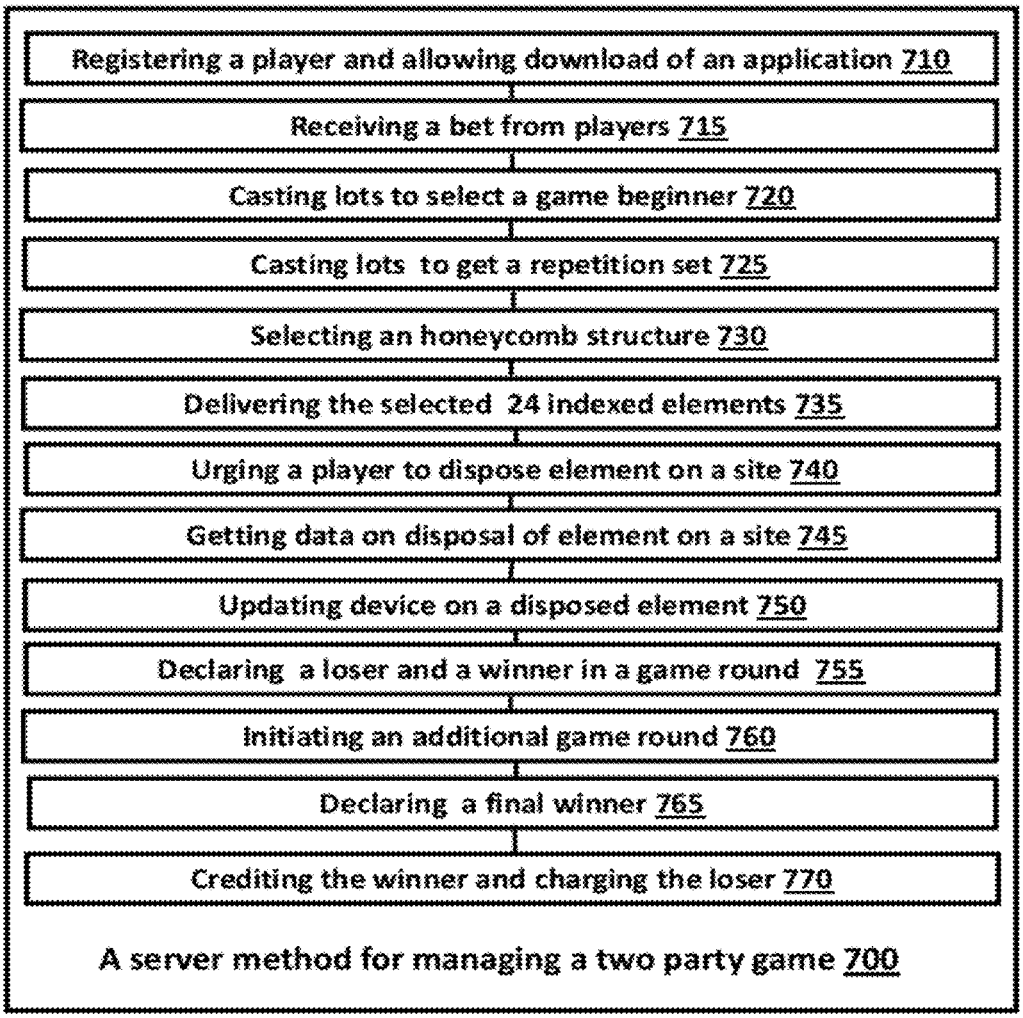
FIG. 7 is a flow chart of a server method for managing a two party honeycomb game.
Figure 8:
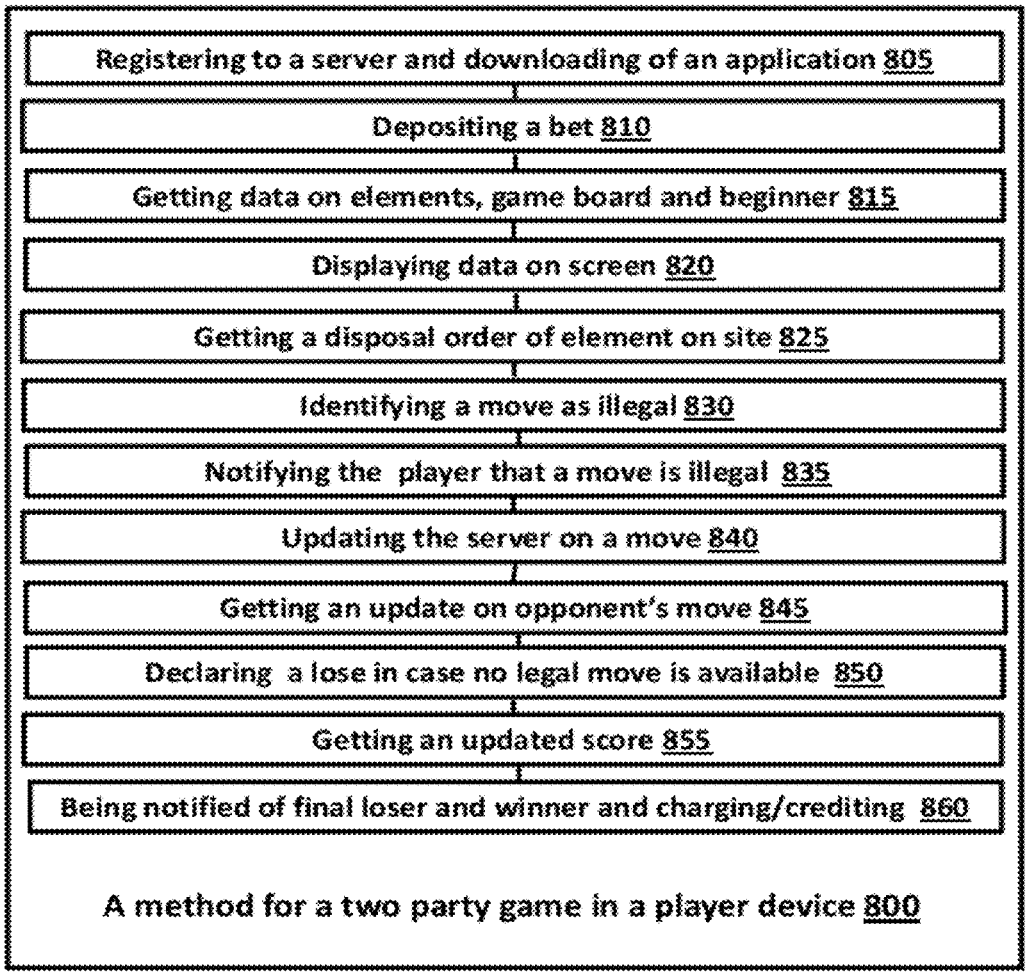
FIG. 8 is a flow chart of method for managing a two party honeycomb game in a player's device.

FIG. 6 presents a different distribution of the site indexes. In that distribution, each player has at least one site of each hexagon.

The 24 indexed elements for the bank may be selected in a cooperating phase in which the two players dispose elements from a common bank of 36 indexed elements on the honeycomb cardboard such that no two identical indexed elements are disposed on the same external hexagon. After completing the cooperative phase, the 24 elements disposed on the honeycomb cardboard are used as a common bank in a subsequent competitive phase.

Score may be calculated and accumulated based on crediting the winner three points for a game round started by the winner and two points for a game round started by the loser. This credit imbalance compensates for certain inferiority of the starting player. The players may play additional games until either an even number of rounds has terminated and one player has higher score than the other player, or an odd number of rounds has terminated but additional round can not change the winner identity.

Two Party Game-Computerized Embodiment

A wide area network version, for internet or cellular network for example, may be based on allowing two clients bet on a result of a game round or game series, and delivering the bet amount to winner while deducting a share, as common in the gaming industry.

A software module may build the desired set of 24 elements using a random generator.

A server may be connected to two remote players each having an internet or cellular access, and the cardboard and bank are presented in each player screen. Alternatively, the two players use a single device and each player plays in his/her turn.

A software module may simulate a human player, allowing a single player to plat a two party game using a computerized system, a cellular phone, for example.

A server method 700 for managing a two party honeycomb game may include a step 710 of receiving registrants, and allowing downloading of applications to the mobile devices or computers of the registrants, a step 715 of receiving a bet amount from each player, a step 720 of casting lots to select a game beginner, a step 725 of casting lots to get a repetition set, and a step 730 of selecting an honeycomb structure having 12 sites of each index, 12 sites of each of shred and non shared hexagon sites, preferably by casting lots. Method 700 further includes a step 735 of delivering data relating to the selected 24 indexed elements, honeycomb game board and identity of game beginner to the players' devices for local display, a step 740 of urging a player to dispose an indexed element on a hexagonal site, a step 745 of getting data on the disposal of the indexed element on the hexagonal site, a step 750 of updating the devices of the two players in accordance with the disposed element, a step 755 of declaring a loser and winner in a game round, and updating score, a step 760 of initiating an additional game round, a step 765 of declaring a final loser and winner, and a step 770 of crediting the winner and the server side with appropriate share of the bet amount.

A gamer method 800 for managing a two party honeycomb game in a player's device may include a step 805 of registering to the game server, and downloading a game application to a mobile device or a personal computer, a step 810 of depositing a bet amount, a step 815 of getting data relating to the 24 indexed elements, honeycomb game board and identity of a game beginner, a step 820 of displaying the data on a screen, a step 825 of getting an order from the player to dispose certain indexed element on certain hexagonal site, a step 830 of identifying a move as illegal due to either inappropriate destined hexagonal site or the disposed indexed element being identical to an indexed element previously disposed on the same hexagon, and a step 835 of notifying the player on the illegal move. Method 800 also includes a step 840 of updating the server on executed allowed move, a step 845 of getting an update on opponent's move, a step 850 of declaring a loss in case no legal move is possible, a step 855 of getting an updated score, and a step 860 of being notified of final loser and winner, and respective charging and/or crediting.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. In particular, the present invention is not limited in any way by the examples described.

The invention claimed is:

1. A game apparatus comprising:

(a) a plurality of indexed elements, each element having an index selected from a certain group of six different indexes, each indexed element including a material selected from a group of materials consisting of wood, plastic and metal, said plurality of indexed elements including more than 24 indexed elements;

(b) each index of said six different indexes being associated with at least three indexed elements of said plurality of indexed elements;

(c) a printed planar structure having six hexagons arranged in a cycle such that each hexagon having a first neighboring hexagon and a second neighboring hexagon, said each hexagon having six sites, each site adapted to receive an indexed element of said plurality of indexed elements;

(d) said each hexagon having two sites shared with said first neighboring hexagon, two sites shared with said second neighboring hexagon, and two non-shared sites;

(e) a dice cube having a data item on each of its faces, each data item defining a distribution of indexes of 24 indexed elements;

(f) each site of said six hexagons having a site index selected from a pair consisting of a first site index and a second site index; and (g) the sites of said six hexagons consisting six shared sites having said first site index, six non-shared sites having said first site index, six shared sites having said second site index, and six non-shared sites having said second site index.

2. The apparatus of claim 1, wherein said certain group of six different indexes consists of six different colors.

3. The apparatus of claim 1, wherein said certain group of six different indexes consists of six different numbers.

4. The apparatus of claim 3, wherein the six different indexes are six different numbers of a single arithmetic series.

5. The apparatus of claim 1, wherein the apparatus includes exactly 36 indexed elements, six indexed elements are associated with each of said six different indexes.

6. The apparatus of claim 1, wherein in each pre-determined repetition set, each index of said six different indexes is associated with three to six indexed elements.

* * * * *